United States Patent [19]

Phillips

[11] 4,281,938

[45] Aug. 4, 1981

[54] AUTOMATIC PRINT WHEEL ELEMENT CHANGING MECHANISM FOR A SERIAL PRINTER

[76] Inventor: Stephen R. Phillips, 120 El Dorado Rd., Walnut Creek, Calif. 94595

[21] Appl. No.: 112,043

[22] Filed: Jan. 14, 1980

[51] Int. Cl.[3] ..... B41J 3/54

[52] U.S. Cl. ..... 400/171; 400/151

[58] Field of Search ..... 400/171, 149, 150, 151, 400/151.1

[56] References Cited

U.S. PATENT DOCUMENTS

| | | | |
|---|---|---|---|
| 3,645,372 | 2/1972 | Noell et al. | 400/171 |
| 3,892,303 | 7/1975 | Willcox | 401/151 |
| 4,026,403 | 5/1977 | Inose et al. | 400/171 |
| 4,074,798 | 2/1978 | Berger | 400/144.2 |
| 4,088,217 | 5/1978 | Bucknam | 400/171 |
| 4,202,639 | 5/1980 | Rello | 400/144.2 |
| 4,208,140 | 6/1980 | Bucknam | 400/171 |
| 4,214,837 | 7/1980 | Bacher | 400/157.3 |
| 4,217,055 | 12/1980 | Moon | 400/171 |

FOREIGN PATENT DOCUMENTS

| | | | |
|---|---|---|---|
| 2835997 | 3/1979 | Fed. Rep. of Germany | 400/149 |

OTHER PUBLICATIONS

Blean, "Automatic Print Wheel Loader", IBM Technical Disclosure Bulletin, vol. 18, No. 10, pp. 3350–3351 3/76.

Kollar et al., "Multiple Belt Photocomposer", IBM Technical Disclosure Bulletin, vol. 10, No. 4, pp. 418–419 9/67.

Cooper, "Electronic Typewriter Type Font Coding", IBM Technical Disclosure Bulletin, vol. 19, No. 11, p. 4242, 4/1977.

*Primary Examiner*—William Pieprz

*Attorney, Agent, or Firm*—Townsend and Townsend

[57] ABSTRACT

A type element interchange mechanism is incorporated into a high speed serial printer with rotary print wheel and linear carriage movement. A number of print wheels are selectively mountable onto a carriage, which carries a print wheel, print hammer, and print hammer solenoid, from one or more removable carousels, each carousel typically carrying several different type font print wheels. Print wheels are transferred directly between the carriage and a carousel, without the necessity of intermediate transfer mechanisms or steps, through the controlled linear translation of the carriage and the carousel. The print wheel-carrying carousel has a plurality of arms and is rotated to present the desired arm in position for transfer of a print wheel with the carriage. Microprocessor controls are provided so that print wheel changes are implemented automatically in response to input signals defining the desired font type. A computer controlled initialization program is provided which in addition to providing a startup and reset procedure also automatically identifies the print wheel identification numbers by reading coded slots located in the center hub of the print wheels.

16 Claims, 14 Drawing Figures

INITIALIZATION FLOWCHART

CHANGING PRINTWHEELS FLOWCHART

AUTOMATIC PRINT WHEEL ELEMENT CHANGING MECHANISM FOR A SERIAL PRINTER

BACKGROUND OF THE INVENTION

2. Field of the Invention

This invention relates to the automatic identification, selection, and changing of font elements in a serial printing apparatus which utilizes rotary printing elements having a central hub supporting resilient spokes which carry type slugs.

2. Description of the Prior Art

The prior art contains many examples of type element changing devices. Such devices exist in computer-controlled machine tools, in the printing industry and in photo-composition machines, as well as in typewriters. Prior art changing mechanisms utilized with typewriters and printers, such as for example those described in U.S. Pat. Nos. 3,645,372, 3,892,303 and 4,088,217, are slow, mechanically complex and not suitable for incorporation into the present rotary printing element serial printers used in word processors, computer output terminals and intelligent typewriters. This general type of serial printer is commonly referred to as a "daisy wheel" or cup wheel printer (depending on the shape of the print element) and is generally described in U.S. Pat. Nos. 3,954,163, 4,091,911, 4,118,129, 4,126,400, 4,127,336, 4,147,438 and 4,149,808.

A prior art serial printer utilizing a changing mechanism for rotary print wheels, such as that disclosed in U.S. Pat. No. 4,026,403, is limited to exchanging print wheel elements in a known predetermined sequence and in addition uses a complex exchange mechanism or arm that transfers the print wheel elements between the printing station and the storage location, thus requiring two exchanges of the print wheel element for each transfer of the print element.

The present invention overcomes the prior art restrictions by providing a mechanically simple changing mechanism which can rapidly and efficiently change print wheel type elements directly between storage and print carriage in a single exchange under microprocessor control.

A typical example of the requirements for a rapid computer-controlled element changing mechanism in a daisy wheel serial printer is when the text of a scientific document requires the use of Roman type font as well as italics and mathematical symbols, all of which cannot be placed on a single print wheel, which typically has from 88 to 125 characters. Another example is in printing multi-language text such as Japanese, Russian, and English. Thus, in order to appropriately print these types of documents, several exchanges of print wheels is required. Indeed, the rapid speed and the flexibility of prior art rotary print wheel printers are partially defeated by the need to continually stop the printer so an operator can manually change the type elements.

SUMMARY OF THE INVENTION

The present invention alleviates the necessity of having an operator present to manually change print wheel types by automating this function under computer control. This can result in significant savings because an operator is no longer required to tend the printer to change type fonts. Multiple storage and individual selection of print wheels is accomplished using one or more interchangeable and replaceable carousels, each carrying a plurality of print wheels. This invention provides for direct single exchange of rotary print wheel elements between storage and print carriage without requiring any intermediate exchange devices. In addition, microprocessor control is used to initialize and identify the print wheels and provide the logic to interchange them. This is done by using a unique print wheel having encoded identification slots in its central hub so that each wheel can be uniquely identified by an optical reader such that its particular printing parameters, such as character spacing, character type and location, character width, hammer intensity, etc., can be obtained from memory once its identification number is known; this is done automatically without the operator having to be involved in determining or setting these parameters. This is a unique advantage over prior art serial printers which fix and standardize these printing parameters to a very few types, such as 10-pitch and 12-pitch and proportional space print wheels with standardized character locations on the print wheel. In prior art printers the character spacing must be manually changed or, in some cases, automatically switched between these three types. The microprocessor also provides for initialization of the printer and all changer and printer servo-mechanisms.

DESCRIPTION OF THE PREFERRED EMBODIMENT

Figure 1:
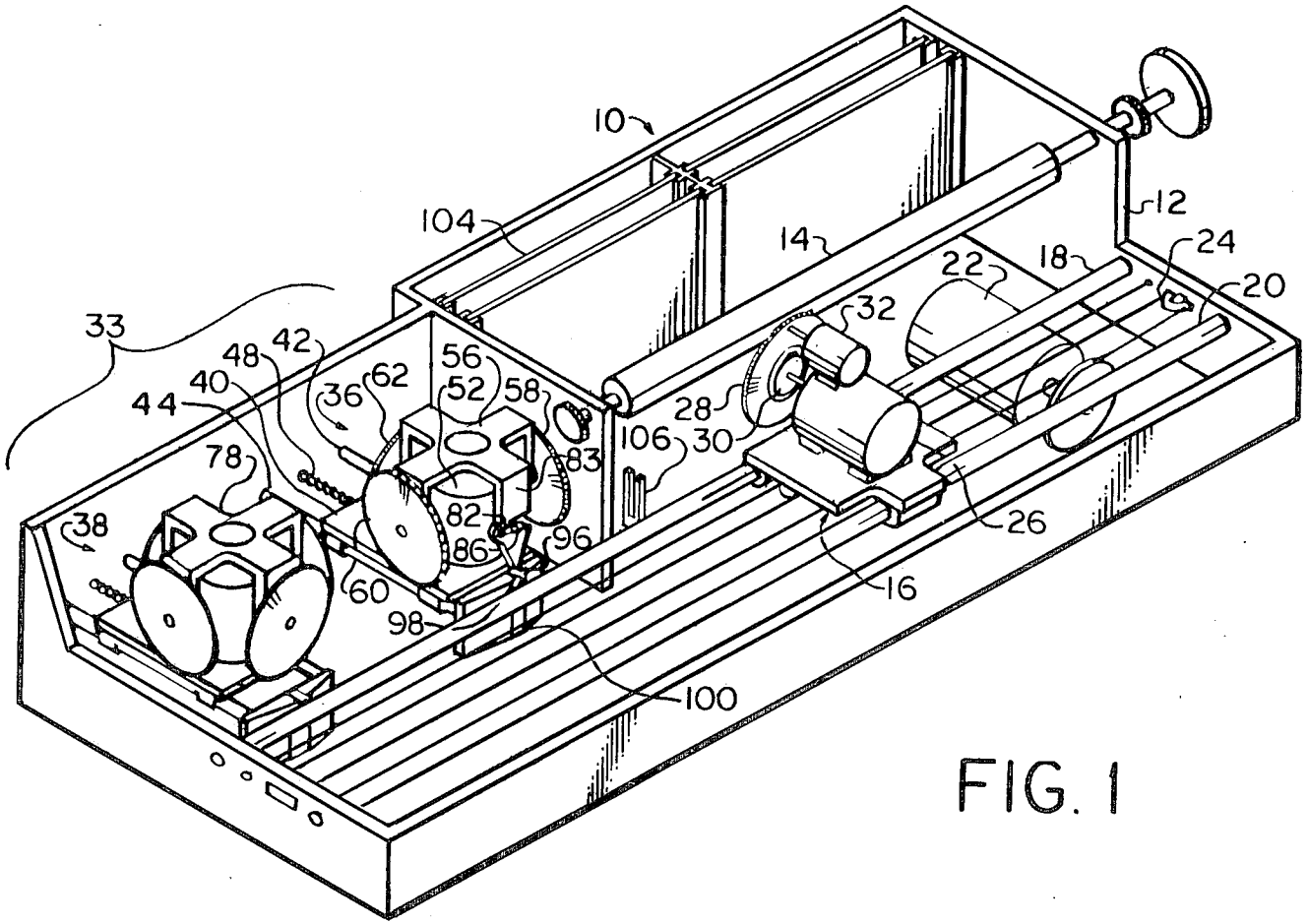
FIG. 1 is an isometric view of a serial printing apparatus according to the present invention and employing a double carousel changing mechanism.

Turning now to the figures, FIG. 1 is an isometric view of a serial printer 10 embodying the invention. Printer 10 has a unitary frame 12 which supports and houses the electrical and mechanical components. A cylindrical platen assembly 14 rotates around its longitudinal axis and supports the recording medium (not shown). A carriage assembly 16 slides on support rods 18 and 20 which extend laterally across the length of frame 12. Carriage 16 is slid along rods 18 and 20 by motor 22, which is typically some form of servo motor or stepping motor, and by pulley system 24. Carriage assembly 16 provides the support for the rotary print wheel drive assembly 26. The print wheel 28 is supported on hub 30 of the print wheel drive assembly 26. Assembly 26 spins the print wheel in order to position different character slugs into the printing position. The print hammer solenoid 32 and an ink ribbon cartridge (not shown for clarity) are also mounted on carriage 16. The platen 14 and carriage 16 are of the conventional design with the lateral movement of the carriage, rotation of the print wheel, and manual or automatic feed mechanism of the platen being provided in a conventional manner.

Figure 2:
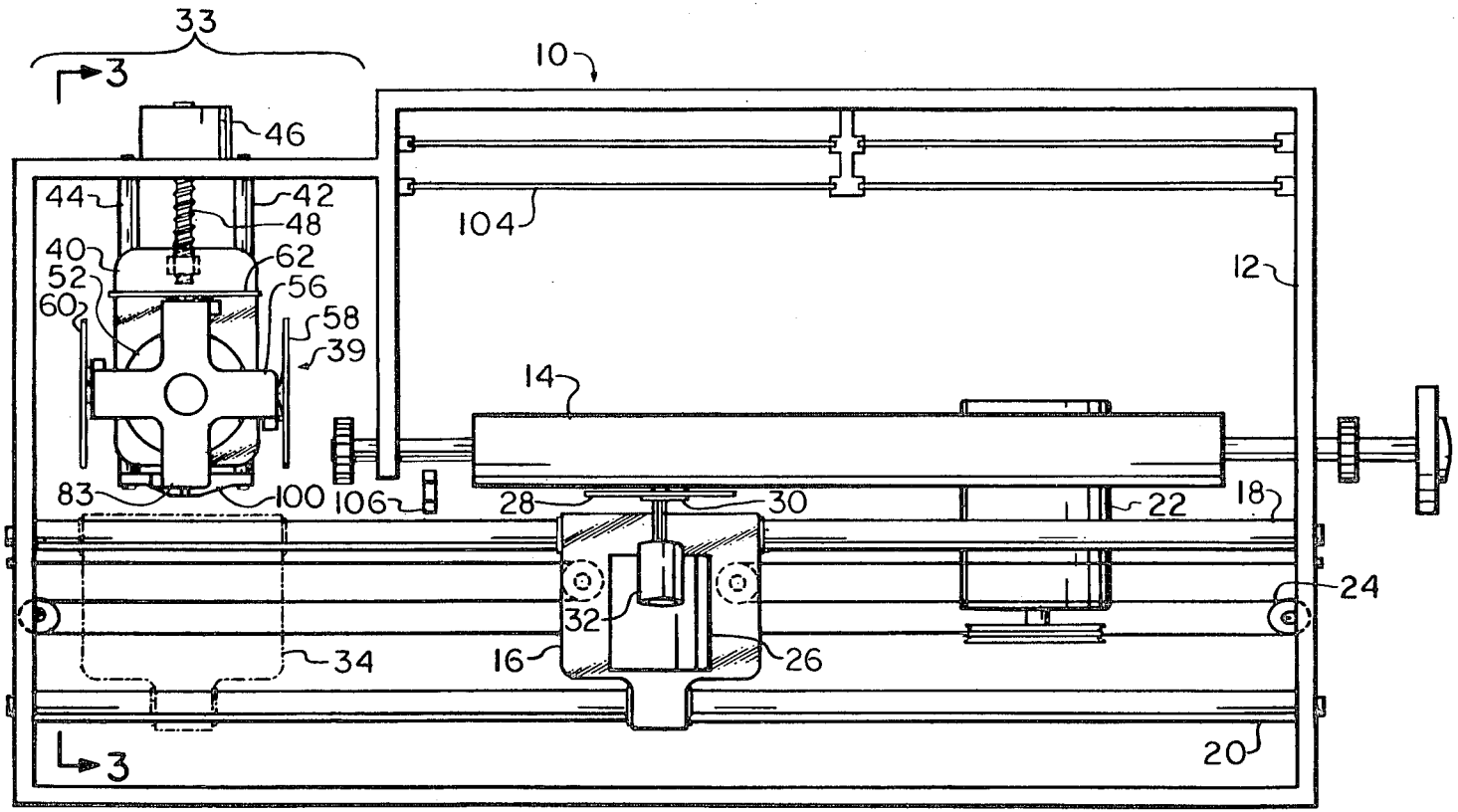
FIG. 2 is a plan view of a serial printer having a single 4-arm carousel.

The carriage support rods 18 and 20 extend into the changer section 33 of the printer as shown in FIG. 1 and FIG. 2. The changer section 33 may contain one or more changer mechanisms. FIG. 1 shows an embodiment with two changers 36 and 38 while FIG. 2 illustrates a printer having a single changer 39. The translation of the carriage assembly to a position in front of a changer allows for exchange and removal of print wheels from the print wheel motor hub 30. FIG. 2 illustrates carriage assembly 16 in front of changer 39 by broken lines. This position is designated exchange position 34.

The changer mechanism has a base 40 and slides backwards and forwards (i.e. away from and towards support rods 18 and 20) on slide rods 42 and 44 to remove and replace a print wheel from the print wheel motor hub 30. This lateral movement translation of the base 40 is through a changer translation encoder servomotor assembly 46 and screw rod 48.

Figure 3:
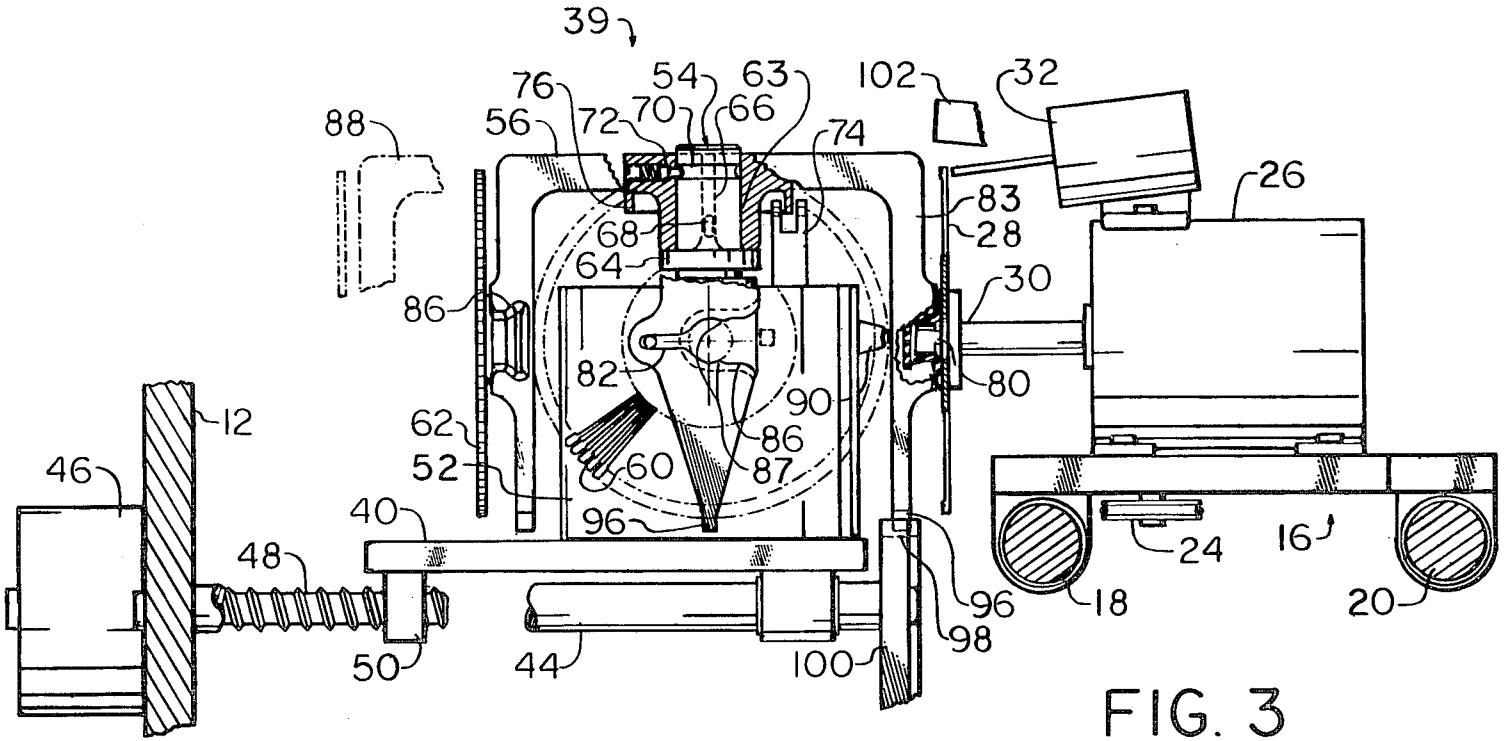
FIG. 3 is a side view of the changing mechanism shown in FIG. 2.

FIG. 3 shows a side view of the changer mechanism to better illustrate its components. Screw block 50 and screw rod 48 to provide the lateral drive for base 40. Base 40 supports the rotation encoder servomotor assembly 52. Its vertical rotatable shaft 54 mates with and is keyed to the removable carousel 56. The carousel shown in FIGS. 1, 2 and 3 is a four-armed carousel holding four daisy wheel print elements. A carousel with a greater or lesser number of carousel arms can also be provided to provide a greater or lesser number of print wheel elements to be stored on a single carousel. Daisy (or print) wheels 58, 60, 62 are shown in FIG. 2 stored on carousel 56. Daisy wheel 28 is shown mounted on hub 30.

The central hub 63 of the removable carousel is mounted over shaft 54 and onto seat 64. To provide rotary indexing, a keyway slot 66 is formed on the internal surface of hub 63 of the carousel 56 and is engaged by a key pin 68 extending from shaft 54. A groove 70 in the shaft 54 is provided so that a spring-loaded pin 72 in the carousel's central hub 63 can engage groove 70 to lock the carousel on shaft 54. An optical switch 74 is provided which detects the presence of flange 76 on the carousel 56 and provides for detection of the presence of a carousel loaded and locked onto the changing mechanism 39.

The daisy wheel 28 mounted on hub 30 may be replaced and exchanged for a print wheel located either on carousel 56 or carousel 78 in the double changer mechanism of the printer shown in FIG. 1, or it can be replaced and exchanged for one of the print wheels 58, 60, or 62 mounted on the single changer mechanism 39 shown in FIG. 2. For the sake of simplicity, the embodiment described below will have only a single carousel.

The method by which the transfer of a print wheel between the carousel of a changer mechanism and the hub of the print wheel drive assembly will now be discussed. The transfer is accomplished after the print wheel is engaged by both the carousel and the hub of the print wheel drive assembly. Generally, after the print wheel is engaged with both the carousel and the hub of the print wheel drive assembly, the movement of the changer back away from the print wheel drive assembly removes the print wheel from the hub of the print wheel drive assembly; on the other hand, movement of the carriage assembly away from changer section 33 and towards platen assembly 14 removes the print wheel from the carousel. Simply stated, the print wheel is retained by the member which moves since the direction of movement of the changer and carriage are perpendicular to one another. By providing direct transfer between the print wheel drive assembly and the carousel, this invention eliminates the necessity of an intermediate exchange mechanism to transfer print elements between the printing station and the storage area. This eliminates the added mechanical complexity which would otherwise result and also eliminates the necessity of requiring a double transfer of the print wheel for each transfer in and out of storage.

Figure 4B:
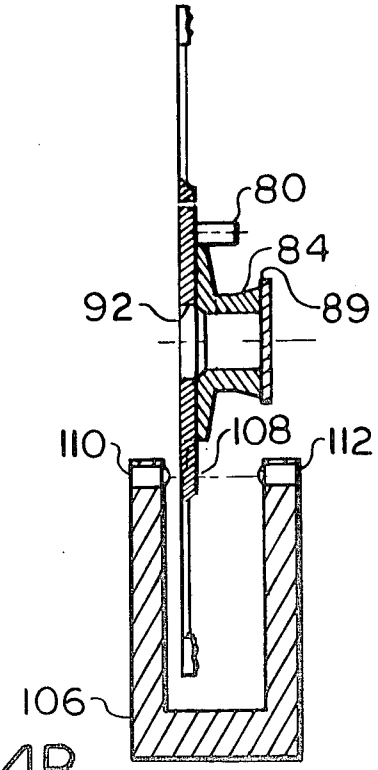
FIGS. 4*a* and 4*b* are front and side views respectively of the optical reader which senses the encoded identification slots of the print wheel and its rotary locating pin and slot.
Figure 4A:
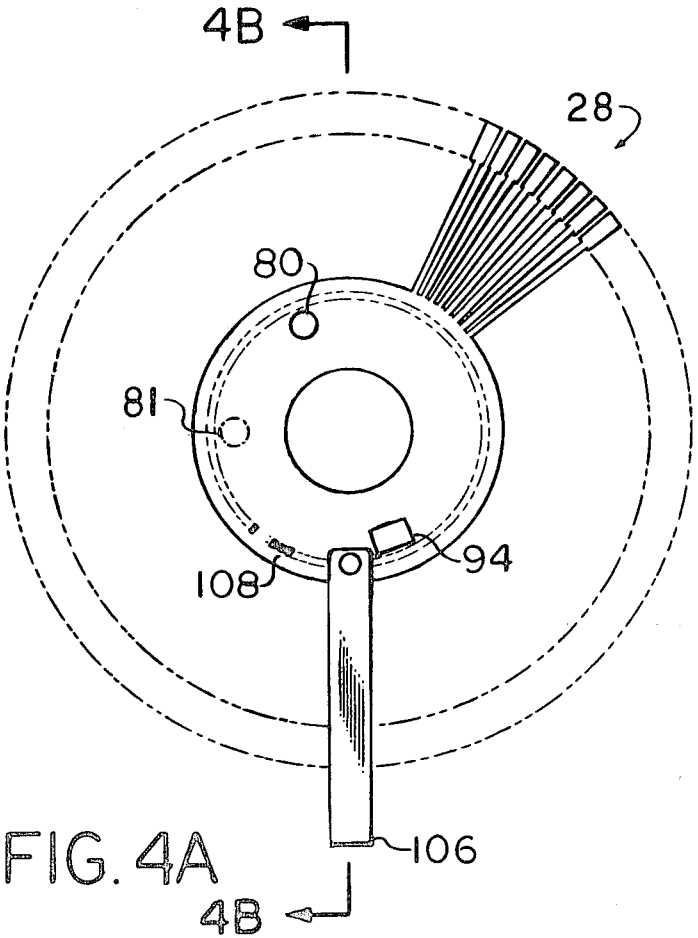

The operation of the changer mechanism can perhaps best be explained by a description of the exchange of print wheel 28 with print wheel 60. The sequence starts with changer mechanism 39 being in a forward or load position as shown in FIG. 3. The print wheel drive assembly 26 rotates the print wheel 28 until the print wheel pin 80 is in horizontal alignment with hub 30. This horizontal position of the print wheel pin is shown in broken lines in FIG. 4 and is designated 81. This horizontal positioning allows the print wheel pin to engage the horizontally disposed slot 82 in the forward-facing carousel arm 83. The carriage 16 now slides laterally into exchange position 34 so that pin 80 is fully inserted within slot 82 and the print wheel hub 84 is also engaged within enlarged portion 86 of slot 82 of carousel arm 83. At this point in the sequence the print wheel 28 is engaged by both the hub 30 of the print wheel drive assembly 26 and also by portion 86 of the slot 82 formed within forward facing carousel arm 83. The print wheel is removed from hub 30 by changer mechanism 39 translating away from the print wheel drive assembly by the action of motor 46 and screw rod 48. Both the enlarged outer rim 89 and the taper of print wheel hub 84, shown best at FIG. 4*b*, act to retain the print wheel on carousel arm 83 during its rearward motion. Once the changer is in the rear-most position, shown by a partial phantom view 88 in FIG. 3, the carousel is free to rotate around the axis of motor 52 to allow print wheel 60 to be indexed to a forward-facing position. The print wheel is retained within enlarged portion 86 of slot 82 by means of detent 87. Optical switch 90 determines the presence of a print wheel 60 mounted on the carousel arm in this forward-facing position. The changer base 40 now slides forward toward print wheel drive assembly 26 by the interaction of motor 46, screw rod 48 and screw block 50 so that the central hole 92 of the print wheel engages hub 30 and its associated alignment pin (not shown). The carriage assembly 16 now moves laterally away from changer section 33 and into a printing position opposite the platen, and in so doing removes the print wheel from the carousel. To prevent the carousel from rotating during this removal period, an extension of the carousel arm is provided with a foot 96 which engages a slot 98 in bracket 100. Bracket 100 is mounted to and retains the ends of rods 42 and 44. This engagement also relieves torque on motor 52 which would otherwise occur during engagement and disengagement of the printer wheel from slot 86. The engagement of foot 96 within slot 98 occurs during the above mentioned forward translation of the changer to its forward or load position.

The carousel stays in this load position with its empty carousel arm facing forward during the subsequent printing operations. It is thus ready to reaccept the print wheel when another exchange becomes necessary. In the above sequence, the ribbon 102, illustrated in FIG. 3, is lifted into a high position so that it will not interfere with the removal of the daisy wheel but is lowered whenever the printer is ready to print.

The storage carousels can be manually removed from the printer by an upward pull of the carousel to disengage pin 72 from groove 70 on shaft 54. This removal can be done when all of the print wheels are replaced back onto the carousel 56 and the changer mechanism positioned rearward in rearward position 88. Once removed from the printer, the print wheels loaded onto the carousel can be manually removed and other print wheels, for example print wheels with different font types, can be installed. This is done by simply urging the print wheel past the detents and out of engagement with the carousel arm and then re-engaging the hub of new print wheel past the detents in the enlarged portion of the slot so that the pin 80 is fully engaged into the slot 82. The alignment pin 80 is provided so that the orienting slot 94, which orients the rotational location of the print character slugs on the print wheel, is correctly aligned when the print wheel is mounted onto the hub 30. A carousel loaded with the desired set of print wheel fonts can then be reinserted onto the changer mechanism 36 by aligning keyway slot 66 and key pin 68 and then pushing the carousel down until it rests on seat 64 and pin 72 is engaged within groove 70.

Once a new carousel is loaded onto the changer mechanism, it becomes necessary for the printer to identify those print wheels that are loaded onto the carousel. Without such information, the operator must manually input this information into the memory of the printer located on circuit board 104. Since this procedure is inefficient, time consuming and error prone, this invention incorporates an automatic identification system. This involves print wheels being sequentially mounted and dismounted between the carousel and the hub 30 of the print wheel drive assembly 26. After being mounted on the hub, each print wheel is positioned between the upwardly-extending arms of the optical reader 106, as shown in FIGS. 1, 2, 4*a* and 4*b*. Once the print wheel is straddled by the optical reader 106, the print wheel motor 26 spins the print wheel so that its encoded slots 108, which provide the identifying number of the print wheel, can be read. This is accomplished by the optical detector 110 which detects the light emitted by the light emitting diode 112. The presence or absence of a slot 108 in the print wheel can, for instance, be determined by comparing the output of photo detector 110 with the electrical counting pulses of the rotary encoder incorporated into print wheel drive assembly 26. The encoded slots 108 provide for automatic number identification of the print wheel in a very conventional manner as is readily apparent to those skilled in the art. Each print wheel's number, for instance 38,100 corresponding to a courier 10 print style, is identified using the optical reader 106 and is stored in the memory of the electronic circuits housed in circuit boards 104.

By providing print wheel identification in a rotary serial printer, several additional advantages are incurred as contrasted with prior art printers which are limited to three standard print wheel types, specifically 10 pitch, 12 pitch and one proportional spaced wheel, each with a corresponding set of standard printing parameters.

By uniquely identifying print wheel types, it becomes possible to reconfigure the movements of the print wheel rotation, carriage translation, paperfeed platen, and print hammer to optimally handle any number of variations in print wheel characteristics all under software control. These variations can involve nonstandard special font types such as proportionally spaced wheels as well as Chinese and Japanese ideographs, Arabic, chemical and nuclear symbols and any other print wheel fonts in which the angular placement of specific character slugs around the print wheel hub is nonstandard and where different size character slugs of varying print areas requiring specific hammer forces for optimal printing quality is required.

Figure 5:
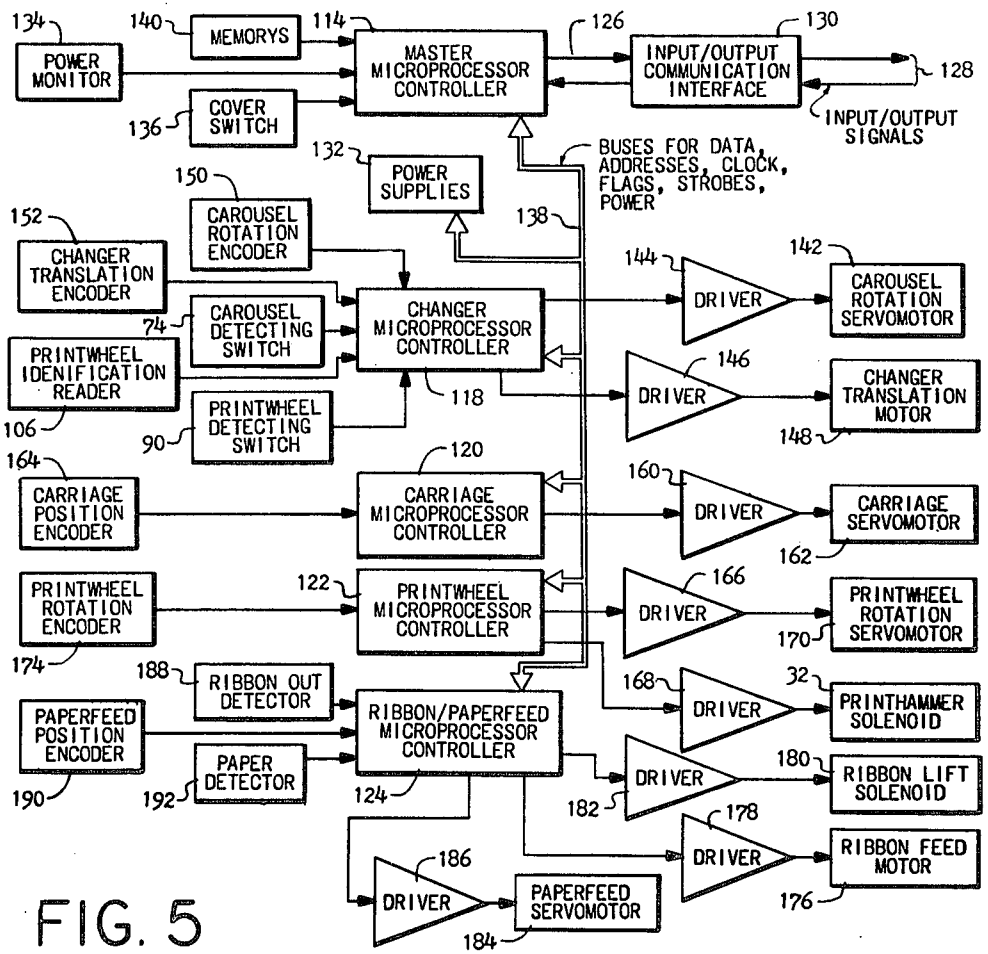
FIG. 5 is a schematic block diagram of the microprocessor control system of the printer depicted in FIG. 2.

When a request is made to the printer for a particular print wheel font style, the microprocessor 114, see FIG. 5, housed on circuit boards 104 scans its memory of wheel identification numbers to see if such a wheel is presently stored on a carousel. If it is, then it can retrieve that print wheel from the carousel. The print wheel's identification number can be used to obtain from either the printer's own internal memory or from an external source, such as a communicating computer or a floppy disk memory device, the particular list of variables which define the optimal printing parameters corresponding to the particular print wheel.

This information would include a list of the specific character slugs that are on the print wheel along with their specific angular location, their intra-character spacing, character width, and the required hammer intensities as a function of the number of carbon copies to be printed. Other printing parameters related to each specific print wheel would include the rotational inertia of the print wheel in terms of the optimal rotational acceleration, deceleration and velocity to be substained by the print wheel motor and the hammer delay times to allow for bending, vibration, and damping characteristics of the radial slug spokes of the particular print wheel. Thus for example plastic, metal clad, and reinforced plastic print wheel types could all be accomodated. Additional printing parameters would enable the printer to handle, interchangeably, print wheels having multiple character slugs mounted on each radial wheel spoke by evoking additional print hammers and/or vertical shifting of the print wheel carriage.

Once this information is transferred into the working memories of the printer, the printer can then print at both optimal speed and with optimal printing quality using the particular print wheel on the hub of the print wheel drive assembly.

Referring to FIG. 5, the controller for the serial printer is diagrammatically illustrated. The electronics located on circuit boards 104 contain the master microprocessor 114 which controls the sequence of operations of the slave microprocesses 118, 120, 122 and 124. The design of these microprocessor based controllers is conventional and known to those skilled in the art.

A brief explanation is now provided for these microprocessor based controllers.

Input signal lines 126 allow communications 128 with the external computers or keyboards via the communication interface 30. Requests for a particular font style and transmission of printable textual material is transmitted over this communication interface. Electrical power is provided by power supply 132 and a conventional power on/off monitor 134 is provided to alert the microprocessor in the event of power fluctuations as well as to reset and initialize the printer whenever the power comes on. A safety cover open switch 136 is provided to stop the machine in the event that the cover on the printer is opened. Standard power and data buses 138 allow for two-way communication between all of the microprocessors. Specifically, these buses provide power, data, address and clock information, as well as flag and strobe lines. In addition, computer memory 140 is provided.

The changer microprocessor controller 118 controls the carousel rotation motor 142 which is driven via electronic driver 144. Microprocessor 118, by way of a driver 146, controls the action of changer translation motor 148. Microprocessor 118 monitors input from five sources: 150 is the position encoder for the rotation of the carousel; 152 is the changer translation position encoder; the carousel loaded detecting switch 74; the carousel print wheel detecting switch 90; and the print wheel identification optical reader 106. The combined carousel rotation encoder 150 and servomotor 142 comprise the carousel rotation encoder servomotor assembly 52. The changer translation encoder servomotor assembly 46 consists of the encoder 152 and servomotor 148.

The carriage microprocessor controller 120 controls the carriage movement servo motor 162 by way of driver 160. Position and velocity feedback of the carriage is provided to this microprocessor by carriage position encoder 164. Carriage servomotor 162 and encoder 164 combine to make up the carriage position encoder and servomotor assembly 206. The rotation of the print wheel and the functioning of print hammer solenoid 32 is controlled by print wheel microprocessor controller 122 which controls drivers 166 and 168, which in turn provide power to the print wheel rotation servo motor 170 and the print hammer solenoid 32 respectively. The position and velocity of the print wheel rotation is provided by the position tachometer encoder 174. The encoder 174 and motor 170 make up the rotary print wheel drive assembly 26.

The microprocessor controller 124 is responsible for controlling the ribbon and paper feed functions. Specifically, the ribbon feed motor 176 is activated by controller 124 through driver 178 and the ribbon lift solenoid 180 is actuated by controller 124 and powered through driver 182. The paper feed servo motor 184 controls the movement of the paper around the platen. Control of motor 184 is similarly accomplished by controller 124 through driver 186. The ribbon-paper feed microprocessor 124 receives signals from the ribbon out detector 188, which senses when the ribbon must be replaced, the paper feed position tachometer encoder 190, and the paper out detector 192, which detects the leading and trailing edges of the paper held around the platen 14.

Figure 9A:
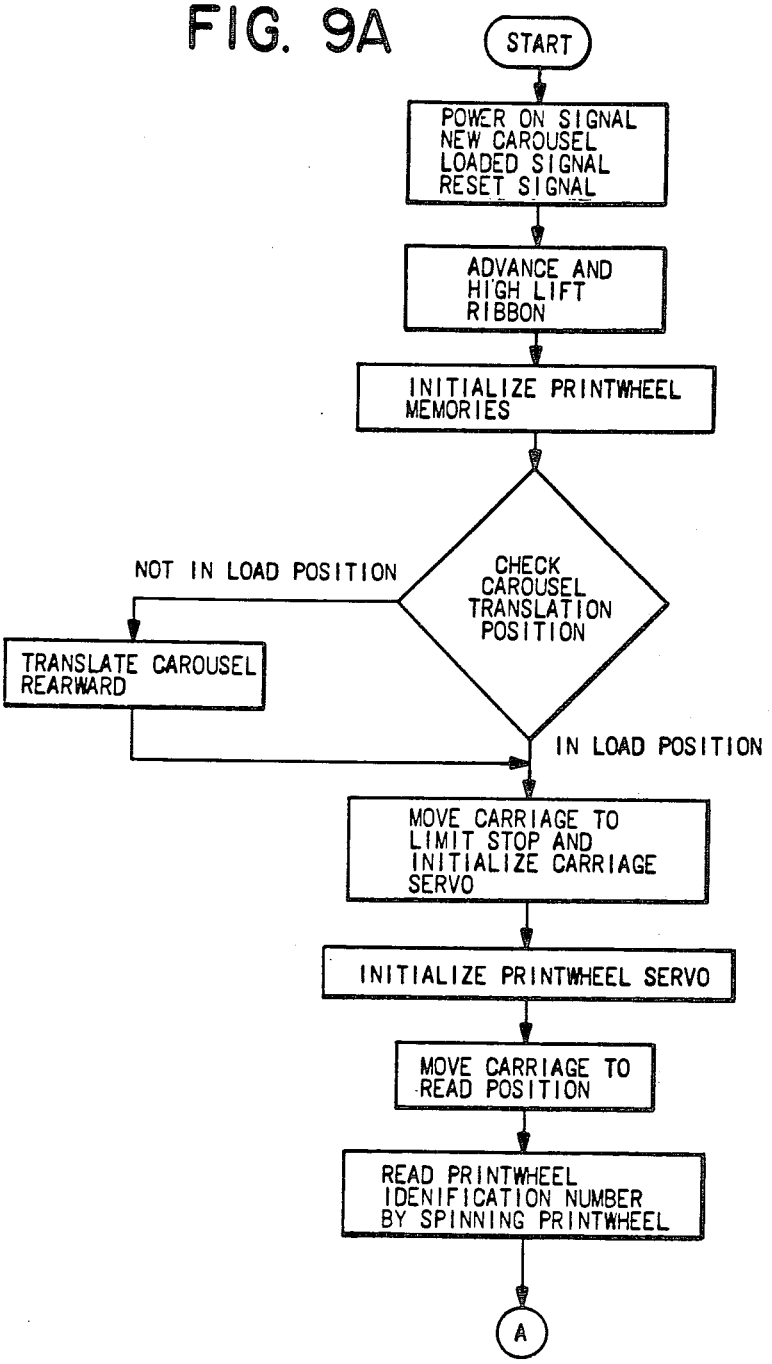
FIGS. 9A–9C are flow charts of the programmed steps for the initialization sequence.
Figure 9B:
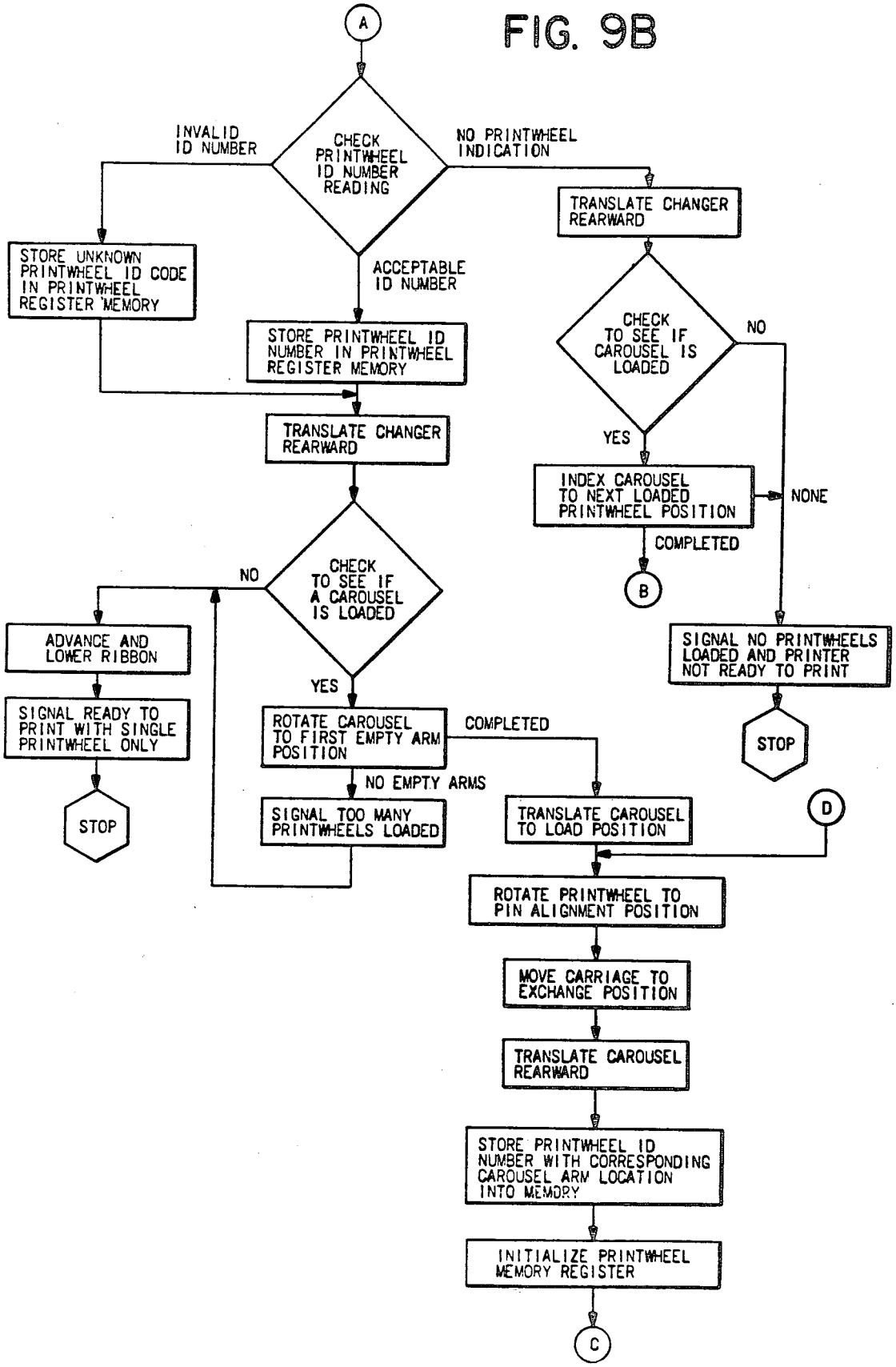
Figure 9C:
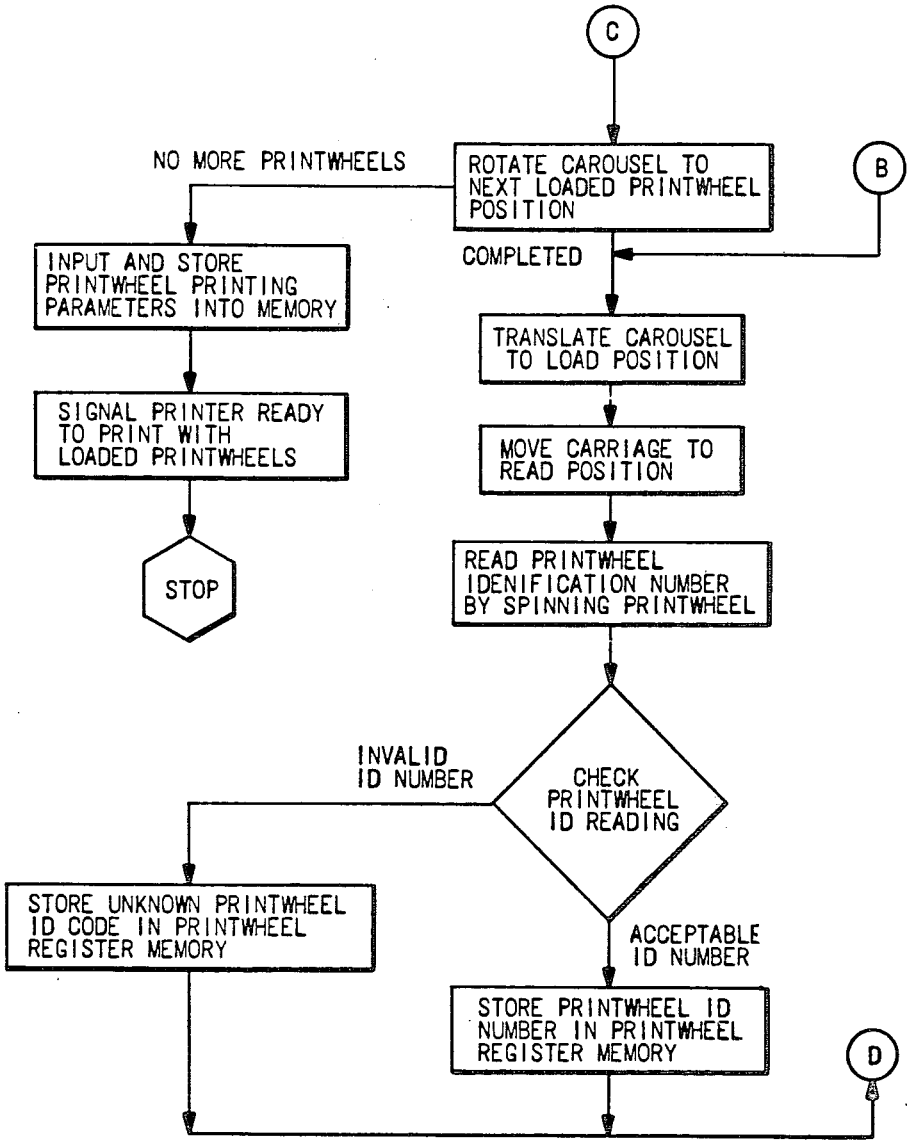

Of course various modifications and changes could be made in this microprocessor based control system such as using a minicomputer rather than microprocessors. In addition, it is possible to use fewer or even one microprocessor to control all the functions. Other changes, such as using rotary or linear stepping motors could be used in place of the presently used D.C. servomotors, are contemplated as being within the scope of the invention. The flow diagram at FIGS. 9A–9C is of the computer logic enacted by microprocessors 114, 118, 120, 122 and 124 in order to initiate both the printer and changer mechanisms when power is first turned on, a new carousel is loaded, or when a reset signal is received. This programmed procedure allows the printer to handle any mechanical configuration that it may find itself in by providing a logical sequence to prevent jamming and to determine the existence and identity of various print wheels that may be loaded on the carousel(s) or onto the carriage.

The initialization sequence of FIGS. 9A–9C is started by either the power coming on, a new carousel being loaded into the printer or a reset signal being received either from an external computer or keyboard. Once one of these three possible signals is received, the print wheel memories are initialized which is followed by the lifting of the ribbon to clear it from the print wheel. While lifting the ribbon, the ribbon is also slightly advanced to prevent it from binding on the print wheel slugs. The first check is of the carousel translation position. If the carousel is found to be located in either the forward (load) position or the rearward position (away from support rods 18, 20), it is left in these respective positions. If, however, the carousel is between these two positions, it is moved to the rearward position.

The carriage assembly 16 is now moved to a limit stop to initialize the carriage servo position mechanism. Simultaneously, the print wheel servo mechanism can be initialized by spinning its shaft. This is then followed by the carriage translating to the read position so that the print wheel identification can be read by spinning the print wheel.

As is shown in FIG. 9B, a check is made of the print wheel identification reading obtained. There are three possible results of this check. The first is an indication that no print wheel is loaded onto the carriage assembly 16. If this occurs, then first, the changer mechanism is translated rearward, if not already in this position, followed by the the next check as to whether or not a carousel is mounted on the changer mechanism. If no, then it means that there are no print wheels loaded into the printer at all. A signal is produced to indicate that no print wheels are loaded into the printer and that the printer is not ready to print. This signal can be transmitted to an external device, for instance on the output lines. If, however, a carousel is loaded onto the changer, then the carousel is rotationally indexed until optical switch 90 senses a print wheel in the forward-facing position. If no print wheels are found on the changer, a signal is outputed to indicate that no print wheels are loaded into the printer and that the printer is not ready to print.

Returning now to the check of the print wheel identification readings, the second possibility is that an invalid identification number is obtained. This means that either the print wheel does not contain proper identification slots or that the identification number itself is not meaningful. In this case the microprocessor stores into the print wheel memory register a number code that denotes that the presently loaded print wheel is of unknown identity. The third possibility is that an acceptable identification number is obtained from the print wheel. In this case, this print wheel identification number is stored in the print wheel register memory.

After the changer translates to the rearward position, if not already in this position, the next check in this sequence is whether or not a carousel is loaded into the printer. If no, then ribbon is slightly advanced while it is lowered into the normal printing position and a ready signal is outputed to indicate that the printer is now ready to print with a single print wheel only: the one already loaded on the hub of the print wheel drive assembly.

If, however, a carousel is loaded into the printer, then the carousel is rotated until the first empty arm position, as detected by switch 90, faces forward so that the carousel can receive the print wheel now on the print carriage. The changer mechanism and the carousel therewith then translates forward to the load position. The carriage assembly moves to exchange position 34 after the print wheel index pin has been correctly oriented. The changer mechanism and carousel therewith then translates rearward, thereby removing the print wheel from the hub of the print wheel drive assembly. Once this is done, the stored print wheel identification number in the print wheel register memory is transferred to the microprocessor memory which pairs identification numbers and carousel arm locations. The print wheel register memory is then erased or initialized. If, however, no empty arm position is found on the carousel, the microprocessor signals to indicate that too many print wheels are loaded into the printer and that the printer cannot replace the print wheel loaded onto the carriage. It also indicates that it is ready, however, to print with the single loaded print wheel only.

Continuing the initialization flow diagram at point "C" in FIG. 9C, the carousel rotates to the next loaded print wheel position. If no additional print wheels are found on the carousel, the only print wheel found on the serial printer is that which was originally loaded onto the carriage assembly and then transfered to the carousel. The microprocessor then signals that it is ready to load and print with the previously identified print wheel once all of its printing parameters are inputted from an external source (e.g. computer, memory device, etc.) and stored in memory 140. If another print wheel is found, this next located print wheel is rotated into the forward-facing transfer position and the changer mechanism translates to the load position. This forward movement transfers the print wheel mounted on the forward-facing carousel arm onto hub 30 of the print wheel drive assembly which is waiting at exchange position 34. The carriage assembly then translates to the read position in front of optical reader 106 thereby removing the print wheel from the carousel arm. The print wheel is spun between the optical reader to allow for its identification.

The print wheel identification reading thus obtained is checked. In this case, there are only two possible conclusions from this check. The first, is an invalid identification number in which case the unknown identification code is stored in the print wheel register memory. In the second case, an acceptable identification number is simply placed into the print wheel register memory.

Once this sequence is completed, this print wheel is replaced back onto the carousel and the next print wheel retrieved from the carousel, identified, and replaced back on the carousel. This sequence continues until all of the loaded print wheels are removed, identified and put back onto the one or more carousels. Once this is completed the printer has identified all of the print wheels, knows their location, has stored in its memory the printing parameters of each stored print wheel, and is ready to receive printing instructions which can specify both the font type and text.

Figure 10:
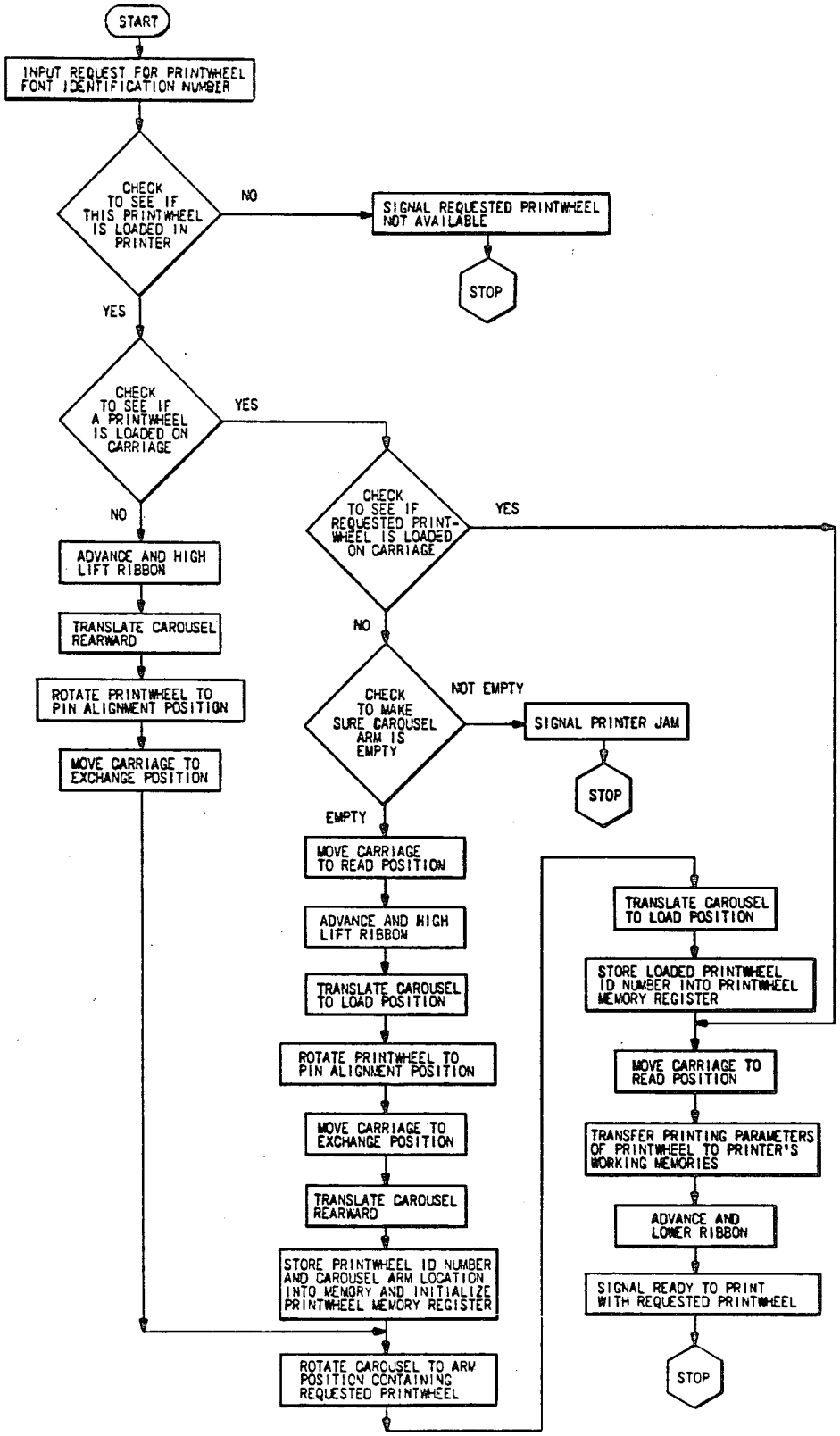
FIG. 10 is a flow chart showing the sequence of steps for changing print wheels.

The operation of the automatic changer in the normal printing sequence is illustrated by the flow chart in FIG. 10. This diagram illustrates a typical print wheel changing sequence where a request is received by the printer for a particular print wheel font identification number. The printer's microprocessor checks its memory to determine whether or not the requested print wheel is available, locates it, mounts it onto the carriage and then indicates that the printer is ready to print with this particular font. The exact and detailed sequence of steps required to interchange print wheels now follows.

Once the printer has received a request for a particular font identification number, a check is made to see if this particular print wheel identification number is loaded into the printer. This is done by interrogating the termporary print wheel register memory and the carousel memory. If no, the printer signals that the requested print wheel is not available in the printer. If yes, meaning that the desired print wheel is within the printer, then a check is made to see if a print wheel is loaded onto the carriage assembly. If a print wheel is already loaded onto the carriage assembly, then a check is made to see if the requested print wheel is the one already loaded onto the carriage assembly. If it is, then the carriage assembly simply moves to the read position the ribbon is advanced and lowered and a signal outputed to indicate that the printer is ready to print with the requested print wheel font.

If, however, the loaded print wheel is not the requested one, then it must be removed and the correct one put onto the carriage. First, a check is made to make sure that the forward facing carousel arm is empty. If it is not, this indicates that something has changed that might cause a jam in the changing mechanism. This would require a reset signal to initialize the servo's and determine what happened to the loaded print wheels. If the forward facing arm is empty, then the carriage assembly moves to the read position, the ribbon is advanced and lifted. This is followed by the translation of the changer mechanism to the load position. The movement of the carriage assembly to the exchange position, once the print wheel index pin is correctly oriented, follows. The print wheel is removed from the hub of the print wheel drive assembly on the carriage assembly by the changer mechanism translating rearward. The removed print wheel identification number is then transferred in the carousel register memory to indicate where it is now stored. The carousel now rotates so that the carousel arm containing the requested print wheel faces forward. Once rotated, the changer mechanism then translates to the load position thus transferring the requested print wheel onto the awaiting carriage assembly. The print wheel identification number is now transferred into the print wheel memory register and the carriage moves to the read position removing the print wheel from the carousel arm. The ribbon advances and lowers which is followed by the transfer of the print wheels printing parameters into the printers working memories and the printer signaling that it is ready print with the requested print wheel. The logic illustrated in FIG. 10 is implemented by the microprocesses of FIG. 5.

Before any particular document is printed, the communicating computer may request from the printer the identity of all of the print wheel fonts that are contained within the printer. With this information the computer, or an operator using a keyboard, can determine whether or not the document can be printed in the desired format by the printer in its present configuration. If the printer does contain the correct print wheels, the printer can go ahead and start printing the textual material. The transmission of the text to be printer is then preceded by the desired print wheel identification number for each segment of text to be printed. The text of a complete page could also be transmitted, along with the associated print wheel identification numbers, so that the printer prints all of characters on the page using the same print wheel. Although spacing may not be as precise, this method may save considerable printing time on documents requiring numerous changes in print wheels for a single page.

If, however, the printer is not equipped with the desired font types, then a request can be made to the printer operator that certain font types need to be loaded into the printer. Once these new font types are loaded into the printer, the printer will initiate itself and upon communication with the external computer can again determine whether or not the document which it desires to be printed can be handled by the printer.

Figure 6:
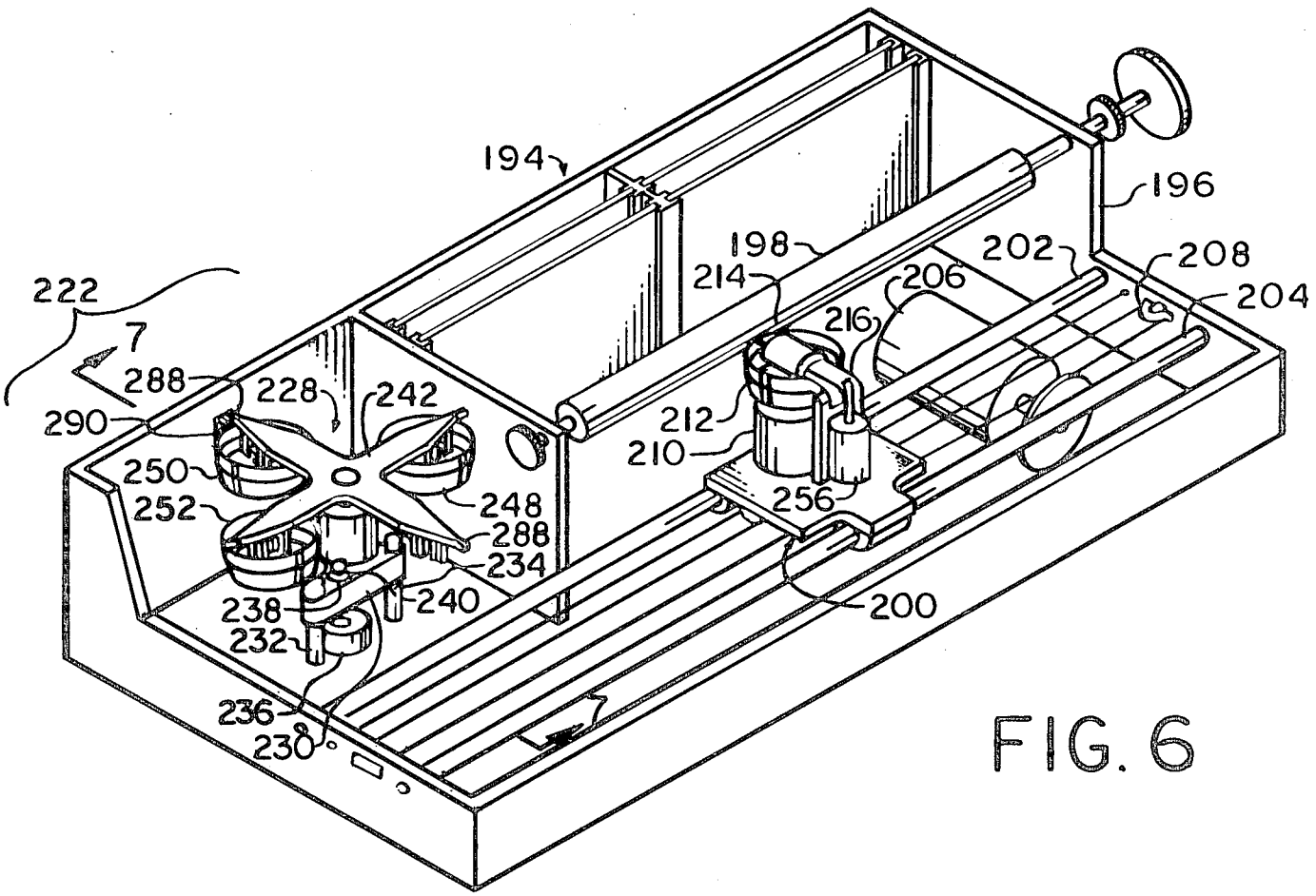
FIG. 6 is an isometric view of a printer having a changing mechanism configured for selectively changing cup shaped print wheels.
Figure 7:
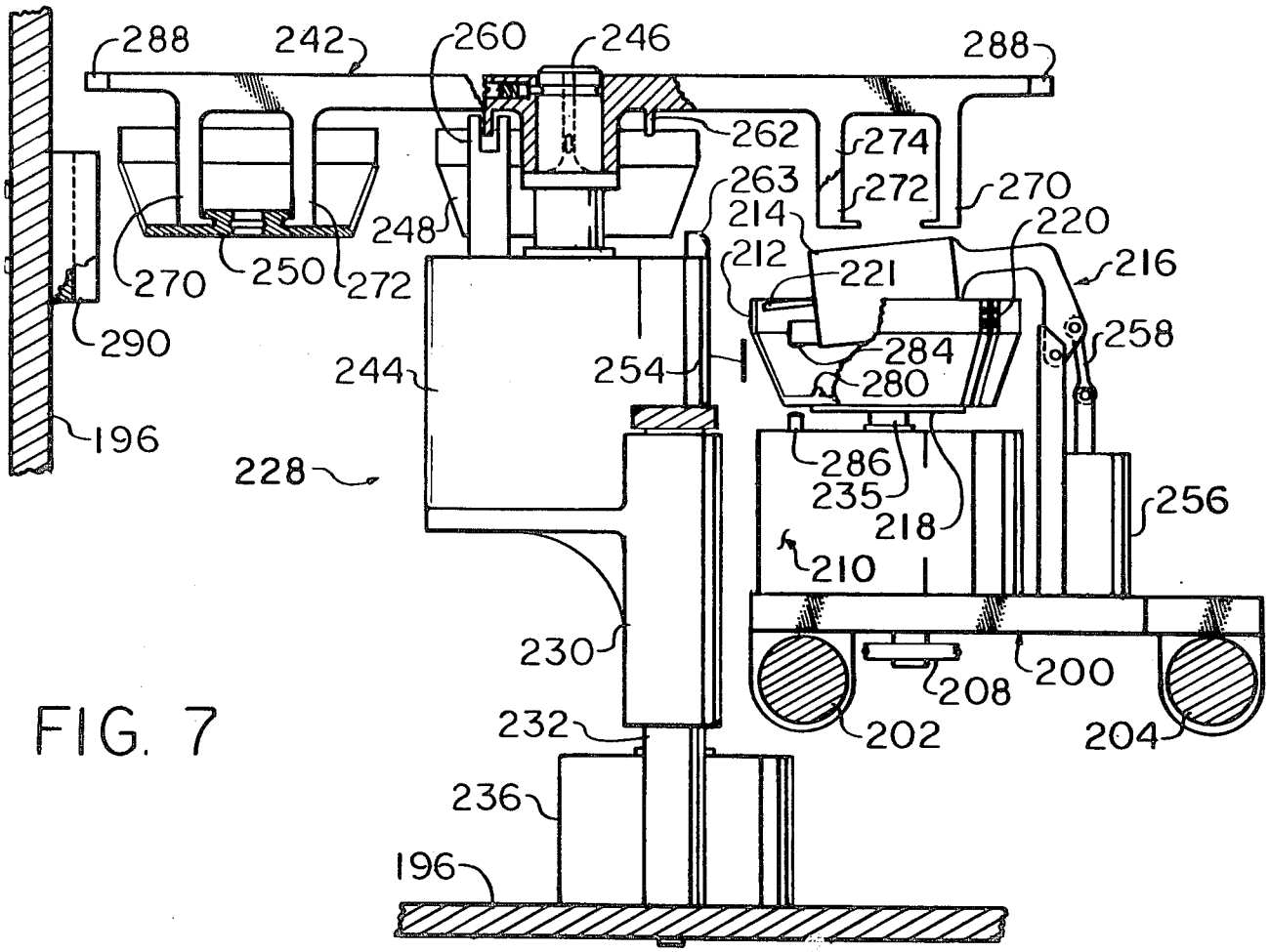
FIG. 7 is an enlarged cross-sectional view of the changing mechanism of FIG. 6.
Figure 8B:
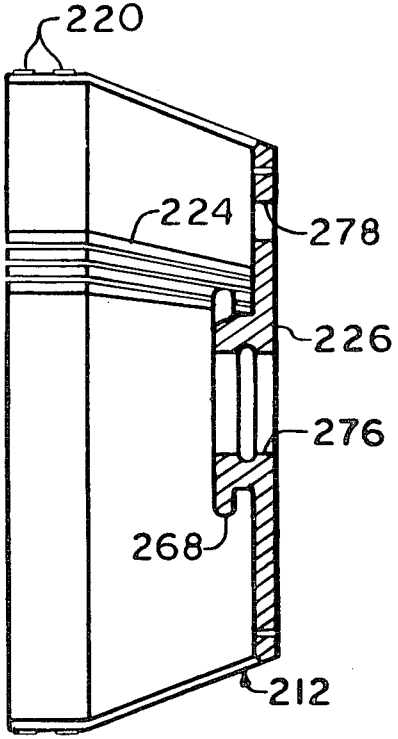
FIGS. 8*a* and 8*b* are front and side views respectively of a cup shaped print wheel illustrating the identification slots and lifting lugs.
Figure 8A:
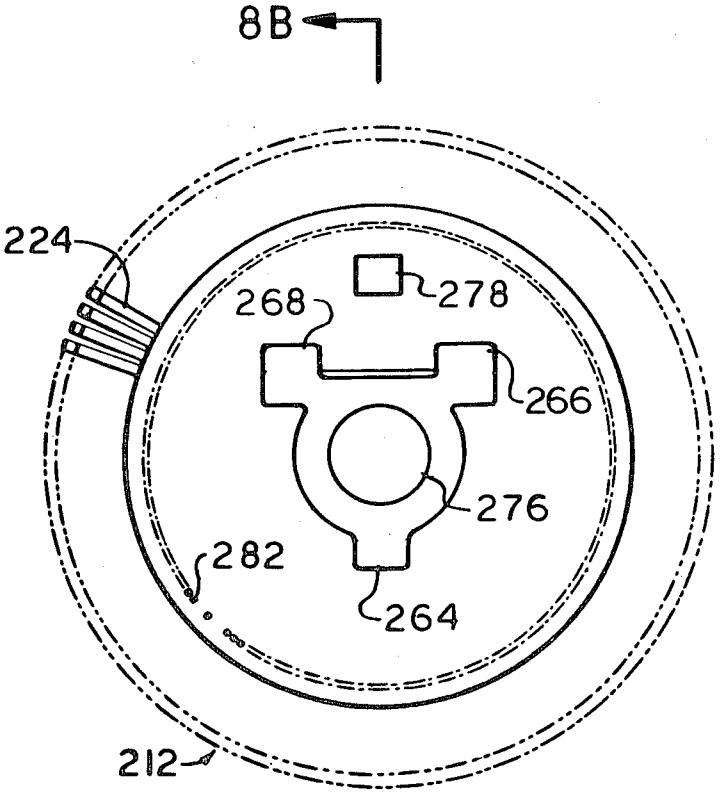

FIGS. 6, 7 and 8 disclose the preferred embodiment of an automatic print element changing rotary printer 194 rearranged so that the changer mechanism is designed to handle cup shaped or truncated cone shaped printwheels that have vertically oriented spin axes as contrasted with the horizontal spin axes of disk shaped daisy-wheel print elements.

The printer 194 has, as before, a unitary frame 196 which supports and houses the electronic and mechanical components of this preferred embodiment. A platen assembly 198 rotates about its axis and supports the recording medium, such as paper (not shown). A carriage assembly 200 slides on support rods 202 and 204 which extend laterally along the length of the frame 196. The carriage is moved along these rods 202 and 204 by a suitable stepping motor or servo motor and rotary encoder 206 and pulley system 208. The carriage 200 provides the support for the vertically orientated rotary print wheel drive system 210, which incorporates both a conventionally designed rotary servo motor and rotary position encoder as well as a vertical shift assembly (details not shown). The carriage also provides support for the print hammer solenoid 214, the hammer lift assembly 216, the ribbon cartridge (not shown) and the print wheel 212. The print wheel motor assembly 210, which supports the cup shaped print wheel 212 on a hub 218 as shown in FIG. 7, both spins and vertically positions the print wheel in order to align different character slugs 220 into the printing position directly in front of the print hammer 221. The print hammer solenoid assembly 214 is positioned directly above and partly within the center of the cup shaped print wheel element. The ink ribbon cartridge and its associated lift solenoid and drive motor (not shown) typically are also mounted on the print carriage 200.

As shown in FIG. 6, the carriage slide rods 202 and 204 extend into the changer section 222 of the serial printer 194. The translation of the carriage assembly 200 into the changer section 222 of the serial printer allows for the exchange and removal of cup shaped print wheel elements from the vertically orientated print wheel motor hub 218. Although FIG. 6 illustrates a single changer mechanism 228, the rotary printer can contain one or more changing mechanisms.

The changer mechanism disclosed in FIGS. 1, 2 and 3 is the preferred embodiment designed to handle disk shaped or daisy wheel print elements while the embodiment of FIGS. 6, 7 and 8 is designed to handle cup shaped or truncated cone shaped print wheels in which the resilient spokes 224 of the print wheel 212 are bent up at an angle with respect to the central hub 226 of the print wheel, shown best in FIG. 8. Each spoke may have 1, 2 or more printable slugs 220. The print wheel motor 210 therefore requires a vertical rotation axis as shown in FIGS. 6 and 7.

FIG. 7 shows a cross sectional view of the changer mechanism 228 to better illustrate its various components. The changer mechanism 228 consists of a base 230 which slides vertically up and down on rods 232 and 234 to remove and replace the cup shaped print wheels from the vertically orientated print wheel motor hub 218. The vertical drive of the base 230 is provided by servo motor 236, screw rod 238 and screw block 240 (see FIG. 6). In this preferred embodiment, the translation of the changer mechanism (or changer) also occurs parallel to the print wheel motor shaft as it does in the previously described preferred embodiment. In this case, however, it results in the storage carousel 242 being translated in the vertical direction instead of the horizontal direction.

The changer base 230 supports the vertically orientated rotational servo motor and position encoder 244. The rotatable shaft 246 supports and connects with the removable carousel 242 in a manner similar to that previously described. The carousel 242 shown in a four-armed carousel with a capability of holding four cup shaped print wheels. A greater or lesser number of carousel arms can be constructed to provide for any number of print wheel elements to be stored on a single removable carousel. Also, more than one changer mechanism can also be employed. The cup shaped print wheels 248, 250 and 252 are shown stored on the carousel while the print wheel 212 is shown mounted on the carriage assembly.

Since the ribbon 254 does not interfere with the vertical removal and replacement of the cup shaped print wheels from the print wheel motor hub 218, the ribbon does not have to be lifted or moved during the print wheel removable or replacement as in the previous preferred embodiment involving disk shaped print wheel elements. However, since the print hammer solenoid 214 is located within and above the cup shaped print wheel 212, this hammer solenoid assembly 214 must be lifted clear when print wheels are removed and exchanged. This action can be accomplished by a number of means, for example, a cam lever linkage can be used which lifts the hammer assembly clear of the print wheel whenever the carriage translates into the changer section of the printer. This action can also be accomplished by an assembly 216 which consists of a solenoid 256, linkage 258 and return spring (not shown) as illustrated in FIG. 7.

An optical switch 260 is provided which detects the presence of a circular flange 262 on the carousel 242 and provides for the detection of the presence of a carousel loaded and locked onto the shaft 246. A second optical switch 263 detects the presence of a print element mounted on the forward facing arm on the carousel 242 when the carousel is in the fully up position. A beam of light emitted by optical switch 263 is reflected back by the outer surface of the print element and detected by the light sensor also contained in the optical switch 263.

The operation of this cup shaped print wheel element changing mechanism is now explained by a description of the exchange of the print wheel 212 mounted on the print carriage 200 with the print wheel 250 stored on the carousel 242. The sequence starts with the changer mechanism 228 being in the fully up position as illustrated in FIG. 7. The print wheel motor 210 rotates the cup shaped print wheel 212 to align the three engagement lugs 264, 266 and 268 shown in FIGS. 8*a* and 8*b* so that they align with the three mating fingers 270, 272 and 274 respectively of the carousel. The optical switch 260 now checks that a carousel is loaded and locked on the changer mechanism 228 while the optical switch 263 checks that the carousel arm is empty and can therefore receive the print wheel 212. The hammer solenoid 214 is lifted clear of the print wheel element 212 by action of the lift solenoid 256 and the linkage 258. The carriage 200 slides laterally by the action of the servo motor 206 and a pulley system 208 into an initial exchange position. In the embodiment shown, this initial exchange position is approximately 7 millimeters short of the final exchange position but could be other distances depending upon the width of the lugs and fingers and so forth. The changer translation servo motor 236 now moves the changer mechanism downward so that the upper surfaces of horizontally extending portions of fingers 270, 272 and 274 of the carousel are coplanar with the lower horizontal surfaces of the three mating lugs 264, 266 and 268. Once this is accomplished, the carriage 200 is moved laterally the remaining distance to the final exchange position, in this case seven millimeters, so that the appropriate fingers and lugs engage, specifically finger 270 engages under lug 264, finger 272 engages under lug 266, and finger 274 engages under lug 268. The three fingers 270, 272 and 274 are designed to be slightly flexible in order to engage and firmly hold the mating surfaces of the three locating lugs 264, 266 and 268 of the print wheel.

The print wheel 212 is disengaged and removed from the print wheel motor hub 218 by the changer mechanism 228 translating vertically upwardly. Once carousel 242 is in the uppermost position, the carousel 242 is free to rotate by the action of motor 244. This uppermost position corresponds to the rearward position 88 of the changer of the embodiment shown at FIG. 3. Being in the uppermost position allows the print wheel element 250 to be indexed to a forward-facing (towards rods 202, 204) direction. The changer base 230 is now drawn vertically downward towards the print wheel motor hub 218 by the action of motor 236, screw rod 238, and screw block 240 so that the central hole 276 and the rotational indexing slot 278 of the print wheel 250 engage the print wheel motor shaft 235 and the rotational locating pin 280 of hub 218, respectively.

The carriage 200 now moves a short distance laterally towards the printing section of the printer to the initial exchange position, here approximately 7 millimeters, to disengage the three fingers 270, 272 and 274 from the print wheel lifting lugs 264, 266 and 268. The carousel 242 is now translated vertically so that its lifting fingers do not interfere with the further lateral movement of the carriage. The carriage 200 now slides laterally into a ready position and the print hammer 214 is lowered by the action of the solenoid 256, linkage 258 and return spring (not shown) so that it is in a position ready to print.

The print element 250 can at this point be spun, if desired, so that the identification slots 282 can be read by the combination of the light emitting diode 284, mounted on the print hammer solenoid 214, and the photo detector 286, mounted on the print wheel drive system 210. The print wheel identification slots 282 contained in the base of the cup shaped print wheels are similar to the encoded slots 108 located on the central hub of the disk shaped print wheel 28.

The removable carousel 242 has a horizontally extending foot 288 projecting from each arm of the carousel. The foot of the rearward-facing (away from rods 202, 204) arm of the carousel engages the channel slot 290, mounted on the frame 196, whenever the carousel 242 is lowered into the load position. This engagement of the foot and channel prevents the carousel from rotating when the print element is being removed or transferred between the storage carousel and the print carriage 200. In the uppermost position, this foot 288 is clear of the channel 290 thus allowing the carousel 242 to rotate.

The microprocessor control of this preferred embodiment utilizing cup shaped print wheels is essentially the same as previously described for the preferred embodiment utilizing disk shaped print wheels with the following addition: The changer microprocessor 118 is additionally responsible for controlling the print hammer lift solenoid 256. The lifting of the print hammer solenoid assembly 214 is required whenever the carriage moves into the changer section 222 of the printer and must be lowered to be ready to print whenever the carriage is in the printing section of the printer opposite the platen 198.

The initialization and print element exchange flow diagrams described for the disk shaped print wheel preferred embodiment printer are essentially the same for this preferred embodiment except for the requirements for the lifting and lowering of the print hammer assembly, for the requirement for an incremental movement of the carriage during cup shaped print wheel element transfer, the requirements for the carousel to be lifted whenever the carriage is moved between the changing section to the printing section of the printer and for the deletion of the previous requirement of the ribbon lift function during print wheel removal and exchange.

I claim:

1. A print element interchange mechanism for use on a serial printer of the type having a rotary print element mounted on a carriage assembly which moves along a printing track parallel to a platen on which a printing medium is advanced, said track having a printing portion and at least one exchange position, the interchange mechanism comprising:

at least one changer assembly mounted for movement along an interchange track which is generally orthogonal to said printing track, said interchange track having a load position adjacent to said exchange position on said printing track and a retracted position remote from said exchange position;

a print element storage carousel mounted for rotation on said changer assembly and having a plurality of arms each ofwhich is adapted to hold a different print element;

means for directly transferring a print element between said carriage assembly and said carousel wherein said print element is simultaneously engaged by one of said carousel arms and by said carriage assembly when said carriage assembly is in said exchange position and said changer assembly is in said load position whereby when either one of said carriage assembly or said changer assembly moves along its respective track, said print element is retained by the moving assembly.

2. The mechanism of claim 1 further comprising indexing means on said carriage assembly and on said carousel for insuring that said print wheel is in proper rotational orientation when mounted thereon.

3. The mechanism of claim 1 further comprising:

means for detecting the presence of a carousel on said changer assembly;

means for detecting the presence of a print element on an arm of said carousel; and means for detecting the presence of a print element on said carriage assembly.

4. The mechanism of claim 1 wherein:

each of said print elements has means for encoding identifying information related to said print element, and further comprising:

means for reading said encoded identifying information from said print element;

means for determining the location of each of said print elements with respect to said carriage assembly and said carousel arms; and means for storing and accessing said print element identifying information and said print element location information.

5. The mechanism of claim 4 further comprising means for storing encoded printing parameter information corresponding to the stored identifying information for the print wheel mounted on said carriage assembly and means for transferring said printing parameter information and said location information to said serial printer so that said serial printer can begin printing using said mounted print element.

6. The mechanism of claim 1 wherein:

said carousel has four arms;

said serial printer has four print elements; and said print elements are daisy-wheel print elements.

7. A rotary type print element interchange mechanism for use on a high speed serial printer, said printer including a frame, a platen over which a printing medium is indexed, a carriage assembly carrying a rotary print element and means for activating selected individual print slugs of said print element, said carriage assembly mounted along a track for movement parallel to said platen, the interchange mechanism comprising:

said printer having a print section and a change section;

said track extending into said change section and having an exchange position for said carriage assembly;

a selectively movable changer mechanism mounted within said changer section and having a rotatable carousel mounted thereon, said changer mechanism having means for moving said changer mechanism and carousel therewith along a path between a load position and a retracted position; said path being normal to said track;

said carousel having a plurality of arms, each of said arms having means for releasably securing a print element thereto;

said carriage assembly having means for securing a print element thereto;

said carousel arms and carriage assembly securing means and said print element configured to allow both said carousel arm securing means and said carriage assembly securing means to simultaneously engage said print element when said changer mechanism is in said load position and said carriage assembly is in said exchange position;

said carousel arm securing means having means for removing said simultaneously engaged print element from said carriage assembly print element securing means when said changer mechanism is moved along said path from said load position towards said retracted position; and said carriage assembly securing means having means for removing said simultaneously engaged print element from said carousel arm print element securing means when said carriage assembly is moved along said track away from said exchange position.

8. The mechanism of claim 7 further comprising:

indexing means on said carriage assembly and said print element for aligning said print element on said carriage assembly so that said print slugs are properly oriented;

means for detecting the presence of a carousel mounted on said changer mechanism;

means for detecting the presence of a print element mounted on an arm of said carousel; and means for detecting the presence of a print element mounted on said carriage assembly.

9. The mechanism of claim 8 wherein:

each of said print elements has means for encoding identifying information related to said print element, and further comprising:

means for reading said encoded print element identifying information from said print element;

means for determining the location of each of said print elements with respect to said carriage assembly and said carousel arms; and means for storing and accessing said print element identifying information and said print element location information.

10. The mechanism of claim 9 further comprising means for storing encoded printing parameter information corresponding to the stored identifying information for the print wheel mounted on said carriage assembly and means for transferring said printing parameter information and said location information to said serial printer so that said serial printer can begin printing using said mounted print element.

11. The mechanism of claim 10 wherein:

there are two said changer mechanisms, each having a carousel mounted thereon;

each of said carousels has four arms;

said serial printer has eight print elements; and said print elements are cup-shaped print elements.

12. The print element interchange mechanism of claims 5 or 10 further comprising:

a dedicateda microcomputer including:

a master controller having a memory;

a changer mechanism controller;

a carriage assembly controller;

a print element position controller;

a paper feed and ribbon controller; amd means for interconnecting said controllers and said changer mechanism; said carriage assembly, a print element position sensor, a ribbon position detector, and a paper feed detector whereby the operation of said mechanism is controlled.

13. The interchange mechanism of claim 12 wherein:

said microcomputer is programmed to initialize the printer by automatically determining the identity of each of said print elements and the respective location of each of said print elements and storing said identities and locations within said memory; and said microcomputer is programmed to automatically exchange a print element mounted on said carriage assembly for a requested print element mounted on said carousel.

14. A method for automatically exchanging rotary print elements on a serial printer, said serial printer having a first print element mounted on a carriage assembly for movement between a printing area and at least one exchange position, said carriage assembly having print element securing means, said serial printer also having a carousel rotatably mounted on a changer mechanism and having a plurality of arms for holding print elements, said changer mechanism mounted for movement toward and away from said exchange position, each of said arms having print element securing means, comprising the steps of:

requesting a second print element;

searching a memory to determine which of said carousel arms has said second print element mounted thereon;

rotating said first print element for alignment with the print element securing means of the carousel arm facing said exchange position;

moving said carriage assembly to said exchange position whereat said carousel arm print element securing means engages said first print element;

moving said changer mechanism, said carousel and said first print element away from said carriage assembly to a retracted position;

indexing said carousel until the carousel arm having said second print element mounted thereon faces said exchange position;

moving said changer mechanism, said carousel, and said second print element toward said exchange position so that said second print element is engaged by said carriage assembly print element securing means; and moving said carriage assembly and second print element away from said exchange position toward said printing area whereupon said printer is ready to print.

15. The method of claim 14 further comprising the preliminary step of initializing the memory of said printer.

16. The method of claim 15 wherein the step of ititialization further comprises:

identifying said print elements;

determining the respective locations of said identified print elements; and storing said identities and said locations of said print elements within said memory.

* * * * *